US006058825A

United States Patent [19]

Harfst

[11] Patent Number: 6,058,825

[45] Date of Patent: May 9, 2000

[54] DEPTH GAUGE FOR CUTTER

[75] Inventor: Michael D. Harfst, Milwaukie, Oreg.

[73] Assignee: Blout, Inc., Montgomery, Ala.

[21] Appl. No.: 08/812,742

[22] Filed: Mar. 6, 1997

[51] Int. Cl.[7] ..... B27B 33/14; B27B 33/02

[52] U.S. Cl. ..... 83/834; 83/676; 83/830; 83/835; 83/840; 30/166.3

[58] Field of Search ..... 83/833, 834, 830, 83/831, 832, 835, 838, 839, 840, 676; 30/166.3, 381, 388, 505

[56] References Cited

U.S. PATENT DOCUMENTS

| | | | |
|---|---|---|---|
| 2,891,586 | 6/1959 | Wright . | |
| 2,912,020 | 11/1959 | Consoletti . | |
| 2,947,331 | 8/1960 | Irgens . | |
| 3,346,025 | 10/1967 | Anderson et al. . | |
| 3,380,496 | 4/1968 | Hill . | |
| 3,473,582 | 10/1969 | Lanz et al. | 83/832 |
| 3,548,897 | 12/1970 | Ekrud . | |
| 3,714,974 | 2/1973 | Bullard . | |
| 4,269,100 | 5/1981 | Deelman et al. . | |
| 4,348,926 | 9/1982 | Dolata et al. . | |
| 4,348,927 | 9/1982 | Olmr . | |
| 4,353,277 | 10/1982 | Silvon | 83/833 |
| 4,425,830 | 1/1984 | Atkinson . | |
| 4,562,762 | 1/1986 | Dubler . | |
| 4,567,803 | 2/1986 | Anderson . | |
| 4,581,968 | 4/1986 | Gibson et al. . | |
| 4,590,836 | 5/1986 | Doiron . | |
| 4,604,932 | 8/1986 | Doiron . | |
| 4,608,901 | 9/1986 | Doiron . | |
| 4,625,610 | 12/1986 | Petrovich . | |
| 4,750,395 | 6/1988 | Doiron . | |
| 4,762,044 | 8/1988 | Kolve . | |
| 4,813,323 | 3/1989 | Harfst . | |
| 4,841,825 | 6/1989 | Martin . | |
| 4,896,575 | 1/1990 | Sundstrom . | |
| 4,911,050 | 3/1990 | Nitschmann . | |
| 4,989,489 | 2/1991 | Pinney | 83/840 |
| 5,085,113 | 2/1992 | Pinney . | |
| 5,165,318 | 11/1992 | Wesley | 83/834 |
| 5,666,871 | 9/1997 | Burrows et al. | 83/834 |
| 5,740,715 | 4/1998 | Burrows et al. | 83/834 |

*Primary Examiner*—Clark F. Dexter
*Attorney, Agent, or Firm*—Klarquist Sparkman Campbell Leigh & Whinston, LLP

[57] ABSTRACT

A cutter device has a cutter portion which is led by a depth gauge. The depth gauge is mounted on and extends upwardly from a substantially planar main body section. The depth gauge has a forward, or first section which extends upwardly from the main body, and when viewed from above is disposed at an angle relative to the central plane of the main body diverging therefrom on progressing rearwardly. The rear end of the first section is connected at a juncture section to a second section which progresses rearwardly and is disposed at an angle converging toward the central plane. The second section may extend across the plane of the body and diverge from the opposite side thereof on progressing rearwardly. The upper surface of the depth gauge presents a sweeping curve as viewed from the front of the cutter which is a multiple of the thickness of the body to which it is attached to provide effective cut control for the following cutter.

24 Claims, 5 Drawing Sheets

DEPTH GAUGE FOR CUTTER

BACKGROUND AND SUMMARY OF THE INVENTION

The present invention relates to an improved depth gauge to be used with a cutter.

Cutters for cutting devices movable along a path for cutting a kerf in a workpiece, such as may be found in a saw chain or saw blades for cutting wood, often have a cutter portion with a leading cutting edge and a depth gauge portion spaced forwardly of the cutting edge to control the depth of cut taken by the cutter. In powered devices the depth gauge is instrumental in reducing the possibility of kick-back during operation of the saw on which the cutter runs.

Depth gauges in the past generally have included a single thickness of cutter material which extends upwardly in a region spaced forwardly from the cutter edge as disclosed in Silvon, U.S. Pat. No. 4,353,277. These prior devices generally have presented to the kerf little more width than the thickness of the plate material from which the cutter or depth gauge is formed.

Other prior devices have included cantilever-style bent-over depth gauge portions such as disclosed in U.S. Pat. Nos. 5,085,113 and 4,989,489 to Pinney, U.S. Pat. No. 4,911,050 to Nitschmann and U.S. Pat. No. 4,841,825 to Martin.

A single thickness upright depth gauge as illustrated in 4,353,277 may have a tendency to dig into the workpiece and not provide consistent cutting depth control. Bent-over depth gauges in the past often have had weaknesses at the bend and had a tendency to break in operation. Although prior bent-over depth gauge devices provide depth of cut control, they can produce excessive friction and drag and also inhibit the free flow of chips produced by the cutters. Explaining further, if chips produced by the cutter are not allowed to flow easily under the top plate of the cutter, they will continue to build up in the kerf, and the depth gauge and cutter will tend to ride thereover producing inefficient cutting.

An object of the present invention is to provide a novel depth gauge for a cutter which overcomes the disadvantages of prior devices in an efficient and cost-effective manner.

In one embodiment of the invention, the depth gauge extends upwardly from a substantially planar body portion and when viewed from the side has an upwardly rounded forward-facing surface. However, as viewed from above, it has a rippled, or laterally deformed configuration. The lateral deformation is such as to extend to opposite sides of the main body of the depth gauge, such that when viewed from the front, it has an apparent overall width, as seen by the workpiece, which is considerably wider than the material from which the depth gauge is manufactured.

Further, the laterally deformed, or rippled, depth gauge has all portions thereof extending substantially upwardly from the main body of the depth gauge. Thus it has no bent-over, cantilevered portions which in prior devices have produced weaknesses having a tendency to break. Instead, it's laterally deformed curvilinear configuration adds strength to the depth gauge.

The depth gauge of the present invention is simple to produce, since it can be blanked from plate material to define a selected initial outline, and then deformed laterally to the offset configuration desired to provide a forward ramping configuration which produces advantageous depth gauge control characteristics for a cutter with which it is used. An added advantage of this is that an upwardly curved top surface contour is provided producing more efficient operation for the depth gauge, as opposed to previously used bent-over cantilever depth gauges which generally have substantially flat upper surfaces.

Another advantage of the present invention over previous bent-over depth gauges comes in the filing of the depth gauge to have a proper height relative to a following cutter to maintain desired depth gauge setting. With an upwardly extending, non bent-over configuration as provided by the present invention, filing to maintain desired depth gauge setting should result in no reduction in strength of the part. Conversely, in a bent-over depth gauge such filing may reduce the cross sectional thickness of the material of the depth gauge substantially weakening it.

In one embodiment of the present invention, the depth gauge extends upwardly from a body portion with a forward region, as viewed from above, being disposed at a first angle greater than 2° relative to the plane of its underlying body portion and a second section positioned rearwardly of the first section which, as viewed from above, is disposed at a second angle, also greater than 2° relative to the plane.

In a preferred embodiment on progressing rearwardly in the device the first section diverges at the first angle from the body plane and the second section joins the first section at a juncture section at the rear end of the first section, and then the second section on progressing rearwardly converges toward the body plane. The juncture section may define the greatest distance to which the depth gauge extends to one side of the plane, and the second section may extend across the plane, terminating at the opposite side thereof from the juncture section.

In various embodiments, the first and second sections of the depth gauge may be bent relative to each other about a line that extends upwardly from the body or may be substantially conoid having a central axis which extends upwardly from the body.

In a cutter employing such a depth gauge, a following cutting portion may be spaced rearwardly of the depth gauge, with a forwardly facing cutting edge extending transversely of the cutter at a selected elevation slightly above the highest portion of the depth gauge and with a side cutting edge spaced laterally outwardly of a laterally outward extremity of the deformed depth gauge. The configuration of the depth gauge described herein, may be produced such that the highest portion of the depth gauge is disposed substantially centrally of the side-to-side dimension of the transversely extending cutter edge.

Another advantage of the present invention is that the open space provided between the angularly disposed first and second sections of the depth gauge is able to efficiently gather and carry chips from the kerf. Raised or indented lines or other formations may be formed on the inner surfaces of the first or second sections to assist in carrying chips out of the kerf.

It has been observed that there is a substantially direct correlation between the amount of top surface area which the depth gauge presents to the workpiece and the kick-back protection provided. The present invention provides a substantial increase in top surface area over previously known upstanding depth gauges, and thus produces the added advantage of reduced kick-back potential.

In summary, the invention provides a depth gauge for a cutter having laterally deformed depth gauge sections which provide a top surface which sweeps a far wider area of the kerf than the thickness of the material from which the part is made when moving through the cut. It provides a depth gauge surface which substantial apparent dynamic has width relative to the cutter during operation and increased top surface area.

These and other objects and advantages will become more fully apparent as the following description is read in conjunction with the drawings.

DESCRIPTION OF PREFERRED EMBODIMENTS

Figure 1:
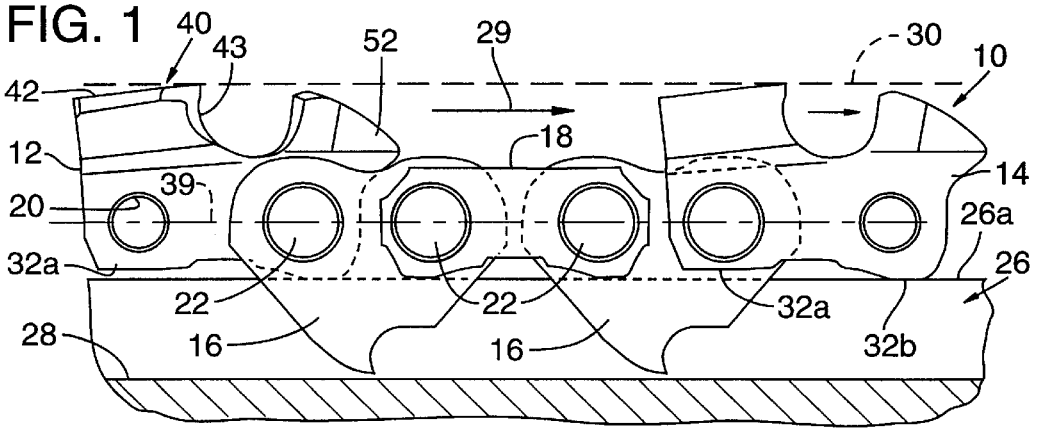
FIG. 1 is a side elevation view of a section of a saw chain incorporating cutters with depth gauges according to an embodiment of the invention.

Referring to the drawings, and first more specifically to FIG. 1, at 10 is indicated generally a section of a cutter chain, or cutter device for use with a chain saw to cut a kerf in a workpiece. The chain includes left- and right-hand cutter links 12, 14, center drive links 16 and connector links 18. All of these links have bores such as that indicated generally at 20, extending therethrough adjacent opposite ends. Rivets 22, acting as pivot pins, extend through aligned bores in the links to pivotally interconnect the cutter, drive, and connector links together.

The chain is supported for travel on a guidebar, a portion of which is indicated at 26, having a groove 28 in which depending tang portions of drive links 16 slidably move. The undersides of the cutter links and connector links ride slidably along supporting guide rails such as that indicated generally at 26*a*, along opposite sides of groove 28.

The direction in which the chain is driven under power to cut a kerf in a workpiece, such as wood, is indicated generally at 29. The kerf is indicated generally in dashed line at 30. As used in describing elements herein forwardly, or front, will mean in the direction of arrow 29, and rear, or rearwardly, will be in a direction opposite arrow 29.

Referring to FIGS. 2–5, a left-hand cutter link 12 is shown in an enlarged form to illustrate an embodiment of the present invention. The cutter, or cutter link, 12 includes a substantially planar upright body portion 32 having a center plane noted generally at 33. Opposed face surfaces 32*a*, 32*b* of the body are parallel to each other.

A pair of spaced-apart rivet receiving bores 20 extend through the rear, or heel, region 32*a* and the front, or toe, region 32*b*, respectively. The centers of bores 20 are aligned on a center line 39 which is generally parallel to the guide rails 26*a* on which the chain runs.

As best seen in FIG. 1, the underside of toe portion 32*b* in the toe region adjacent the front of a cutter is spaced further from center line 39 than is the underside of the cutter body under the rear bore in heel portion 32*a*. Thus, when the center lines of the rivets are aligned as illustrated in FIG. 1, the forward, or toe portions of the cutters will rest on side rail 26*a*, whereas the underside of the heel portion will be spaced a short distance thereabove. This distance preferably is in a range of 0.01 to 0.08 inch. This distance will vary in relation to the size and style of cutter used, however.

The rear end region of the body has a cutter portion 40 thereon. The cutter portion includes a top plate portion 42 and a side plate portion 43. The top plate portion has a forwardly facing, laterally extending cutting edge 42*a* which joins with a vertically extending side cutting edge 43*a* at the forward edge of side plate portion 43.

Figure 4:
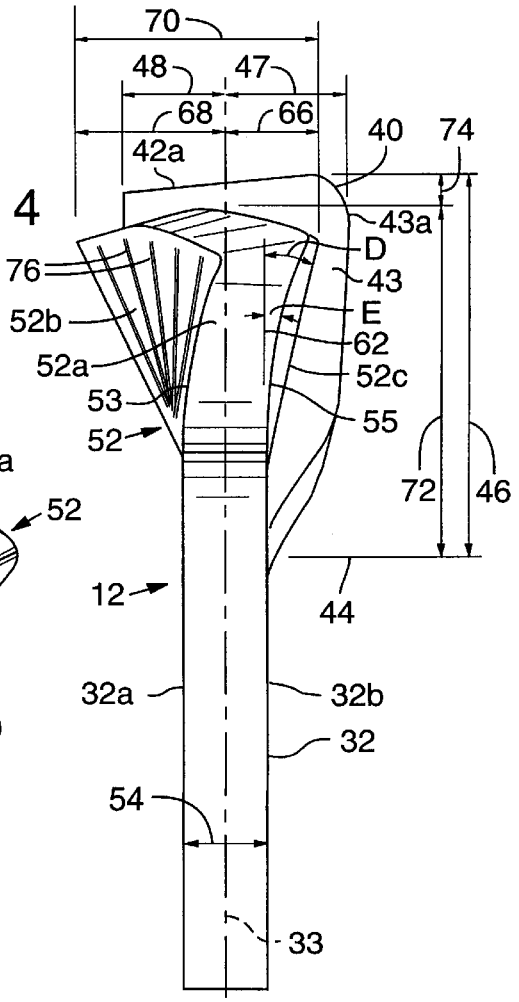
FIG. 4 is an enlarged front end elevation view of the cutter of FIG. 2.
Figure 2:
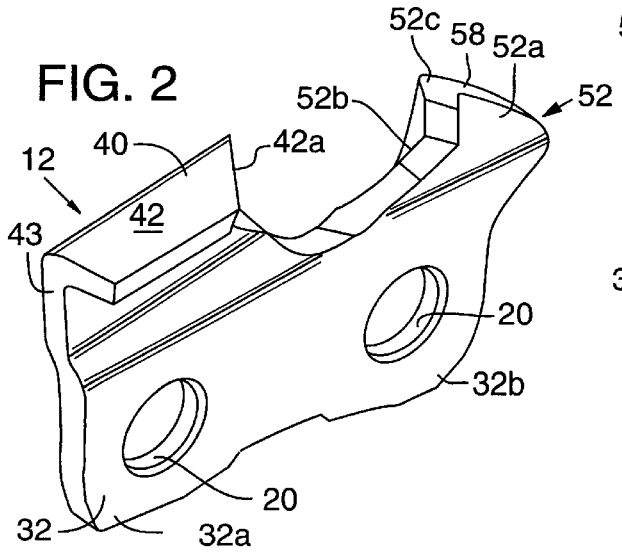
FIG. 2 is an enlarged perspective view of a cutter link removed from the chain of FIG. 1.

As is best seen in FIGS. 2 and 4, side plate portion 43 is deformed to lie in a plane parallel to, but spaced laterally to one side of, center plane 33 of the body portion. The cutter top plate portion 42 is bent-over at substantially a right angle relative to side plate portion 43 and overlies body portion 32. The top plate cutting edge 42*a* extends transversely of the plane of the body portion and overlies the body portion.

In FIG. 4 a line 44 has been placed on the figure to denote generally the transition region between body portion 32 and cutter portion 40. A dimension line 46 denotes a selected spacing at which the top plate cutting edge 42*a* of top plate 42 is spaced above the body portion. Dimension line 47 denotes the horizontal distance to which top plate cutter edge 42 extends laterally to one side of central plane 33 of the cutter and dimension line 48 denotes the horizontal distance to which cutting edge 42*a* extends laterally to the opposite side of plane 33. The total width of the top plate is the sum of dimensions 47 and 48.

A depth gauge, or depth gauge portion, 52 is mounted on and extends upwardly from the front end region 32*b* of the body portion. The depth gauge is formed from the same material and is integral, or monolithically-formed, with the body and cutter portion, having generally upwardly extending opposed parallel face surfaces 53, 55, and substantially the same thickness throughout as thickness 54 denoted for the body portion 32 in FIG. 4. The depth gauge extends generally upwardly from body portion 32 and although it is deformed from the plane of body portion 32, it will be seen that it is not bent over in a substantially normal cantilevered fashion as has been used in bent-over depth gauges as discussed earlier.

Figure 3:
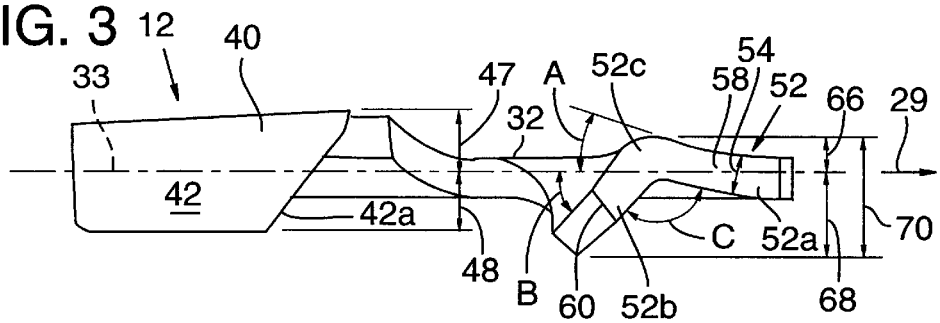
FIG. 3 is a top plan view of the cutter of FIG. 2.

The upper surface, or edge, 58 of the depth gauge has a width that extends between the substantially parallel opposite face surfaces of the depth gauge, wherein the width is substantially equal to the thickness 54 of the body portion 32 as shown in FIG. 3, and wherein the upper surface 58 progresses substantially continuously upwardly from the forward region of the depth gauge in a convex arcuate curve. The upper, or top, surface of the plate material from which the cutter is formed thus provides the surface for the depth gauge portion which will engage the workpiece during operation.

The depth gauge, although a monolithic whole, will be described herein as having a first, or front, section 52*a*, a second, or rear, section, 52*b*, and an intermediate, or juncture, section 52*c*. As viewed from above in FIG. 3, the upper region of first section 52*a* on progressing rearwardly is disposed at an angle A diverging from one side of center plane 33. Angle A may be in a range of from 2° to 90°. Preferably this angle will be in a range of from 10° to 80°.

Referring still to FIG. 3, the upper region of second, or rear, section 52*b* on progressing rearwardly in the depth gauge, is disposed at a second angle B different from the first angle A relative to center plane 33 which may be in a range of from 2° to 90°. Preferably angle B is in a range of from 10° to 80°.

It will be seen in FIG. 3 that there is a slight curve in the first and second sections as viewed from above. This can assist in reducing frictional contact between the side of the depth gauge and the side wall of the kerf cut. Although a slight curve is shown, it should be understood that such could be substantially straight also.

Sections 52*a*, 52*b* are joined by intermediate, or juncture, section 52*c*. The convex outer surface of juncture section 52*c* defines the greatest distance to which the depth gauge extends to one side of plane 33. An included angle C is defined between sections 52*a*, 52*b*, which preferably may be in a range of from 4° to 160°.

Figure 5:
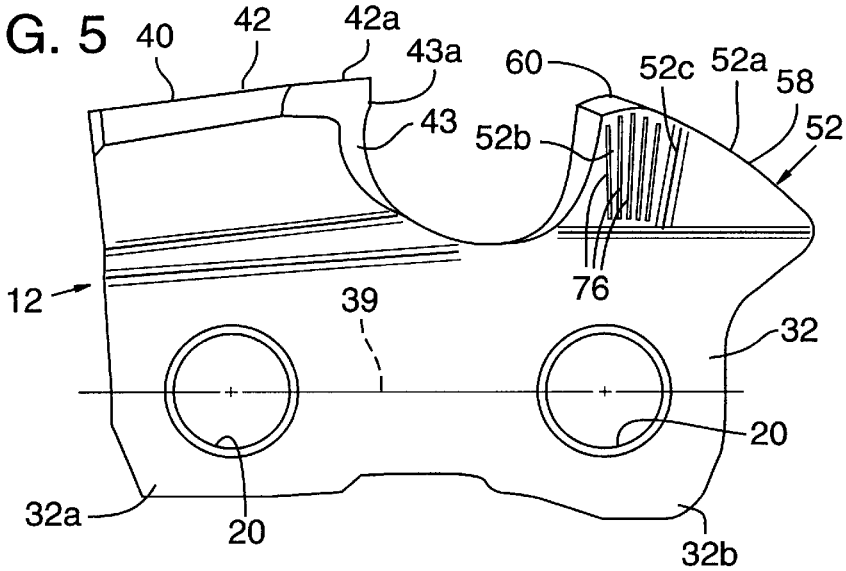
FIG. 5 is a side elevation view of the cutter of FIG. 2.

As is seen in FIG. 3, front, or first section 52*a* diverges from plane 33 on progressing rearwardly to extend to one side of plane 33, and intersects juncture section 52*c* which is farthest to the one side of plane 33. Rear, or second, section 52*b* progresses rearwardly from juncture section 52*c* converging on plane 33, and then extends across and beyond plane 33 toward the opposite side of the plane and diverges from the plane on extending rearwardly therefrom. The top surface 58 of the depth gauge extends substantially continuously upwardly until it reaches a region denoted by line 60 from which it may angle somewhat downwardly as illustrated in FIGS. 4 and 5. Other embodiments may be formed without this downward inclination adjacent the rear end of the depth gauge.

In FIG. 4, a datum line 62 has been provided parallel to center plane 33 and extending directly upwardly from a planar side surface of body portion 32. This datum line is provided to illustrate that the first section of the depth gauge is bent outwardly from the plane of the body portion at an angle which progressively increases on proceeding rearwardly in the depth gauge to produce divergence of the upper region of the first section from the plane. Explaining further, the forward region of first section 52*a* is disposed generally at a first angle denoted E, whereas on progressing rearwardly to a region adjacent juncture section 52*c*, the angle between datum line 62 (and plane 33) and the outer surface of first section 52*a* has increased to that illustrated at D which is greater than angle E. Angle E may be in a range of about 1° to 10° and angle D in a range of about 2° to 30°.

The second section, on the other hand, at its forwardmost point joins the juncture section at an angle generally similar to angle D. Then on progressing rearwardly the angle between the second section and the central plane diminishes until the second section converges on plane 33. After passing the plane 33 the angle of the second section increases.

Referring to FIGS. 3 and 4, it will be seen that the lateral deformation of the first and second depth gauge sections 52*a*, 52*b* respectively, is such that first section 52*a* extends laterally to one side of center plane 33 a distance denoted by dimension line 66. An outermost side portion of the depth gauge at juncture section 52*c* thus is spaced laterally to one side of the plane of the body which is slightly less than the distance 47 to which top plate cutting edge 42*a* extends toward the side plate cutting edge. In this embodiment rear, or second, depth gauge section 52*b* extends a distance 68 to the opposite side of center plane 33. This distance 68 is greater than distance 48 to which top plate cutting edge 42*a* extends to that side of plane 33.

A dimension line 70 denotes the total effective width of the depth gauge which is a combination of dimensions 66, 68. Dimension 70 is the effective depth gauge width seen by the material to be cut. This provides the sweep of the depth gauge which is substantially in excess of the thickness 54 of the body 32. It has been found that it is preferable to have width 70 be at least twice thickness 54 for most effective operation. The width 70 of the depth gauge may be greater than the width (47 plus 48) of the cutter and extend beyond dimension 48. As seen in FIG. 4 the depth gauge extends farther to one side of the center plane (dimension 68) than the cutter (dimension 48).

It has been observed in testing that there is a substantial correlation between the top surface area which a depth gauge presents to the workpiece and the kick-back protection provided. With the present invention, wherein the depth gauge is angled first toward one side and then toward the opposite side in what may be termed a wavy, or rippled, configuration substantially increased top surface area is provided to be presented to the workpiece in operation, over and above that provided in previously known upstanding depth gauges. The substantial increase in top surface area of the depth gauge produces greater control in cutting within the kerf of a workpiece and improves kick-back protection. This increase in surface area is obtained without the structural weakness often associated with cantilever formed, bent-over depth gauges.

Referring again to FIG. 4, dimension line 72 denotes the maximum distance, or elevation, to which the depth gauge extends above the body and illustrates that it is less than the elevation of the top plate cutting edge denoted by dimension line 46. Thus, the selected distance difference 74 between the elevation of the top plate cutting edge and the top of the depth gauge is the effective depth gauge setting for the top plate, and the difference between horizontal dimensions 47 and 66 provides the side plate depth gauge setting for the cutter.

As illustrated in FIG. 4, the highest point for the depth gauge in this embodiment is disposed intermediate the opposite ends of top plate cutting edge 42*a* to provide effective depth of cut control.

A plurality of upwardly directed lines, or carrying elements, 76 as seen in FIGS. 4 and 5 are formed on the inner side surface of the rear section 52*b*. These lines may be formed as depressions or projections from the face surface. Their purpose is to assist in carrying chips from the kerf. Explaining further, chips of material cut from the workpiece by the cutters build up in the somewhat enclosed kerf cut. If these chips are not cleared from the kerf, they can produce an impediment to efficient cutting and depth of cut control. By providing carrying elements, such as lines 76, which may be either depressed or project outwardly from the face surface of the depth gauge, they can frictionally assist the depth gauge in carrying chips from the kerf.

Formation of such a cutter and depth gauge can be easily performed. A piece of flat metal plate stock having parallel, opposed side surfaces, or faces, conforming generally to the thickness 54 of body section 32 is blanked, or cut-out, to a desired initial shape. The plate section then has appropriate portions deformed to provide the offset between the body section and side plate 43, with the top plate portion then being bent-over substantially at a right angle relative thereto. During these operations, the bores 20 are formed and the depth gauge sections 52*a*, 52*b* are deformed from the plane of the body section to the configuration illustrated. The depth gauge thus is formed from a plate element having opposed substantially parallel face surfaces. The depth gauge sections extend generally upwardly from the body portion with an upwardly facing upper plate edge, or surface, extending between the face surfaces. The upper surface as viewed from a side of the cutter as in FIG. 5, is formed in an arc which progresses substantially continuously upwardly through the first section and into the second section. When viewed from the top, as in FIG. 3, the first, or front, section diverges to one side of the central plane of the body portion to the juncture section, and then the second, or rear, section converges at an angle toward the center plane and crosses thereover to extend outwardly to the opposite side of the plane.

The first and second sections are bent relative to each other about a line in the juncture section which extends substantially upwardly from the body section.

The cutter thus described is of a hooded style having the bent-over cutter top plate with laterally extending and upright cutting edges 42*a*, 43*a* positioned on the rear portion of the cutter as noted.

The leading depth gauge portion as viewed from the front as shown in FIG. 4 presents to the kerf an effective depth gauge which is substantially wider than the thickness of the material from which the cutter is formed, and in this case at least twice the thickness, and has increased top surface area.

As seen in FIG. 5, the top surface 58 of the forward section of the depth gauge is substantially continuously angled upwardly progressing in a smooth arc from the first section into the second section of the depth gauge. The manner in which the first section angles outwardly to one side of the cutter provides a smooth transition to the furthest outside edge at the convex curvature of the juncture section 52*c* to provide a side cutting depth gauge setting which is the difference between dimensions 47 and 66 as noted in FIG. 4. As the second section of the depth gauge, on progressing rearwardly, converges toward and then passes the center plane of the cutter body it provides an upper depth gauge portion at the region of line 60 which is intermediate the opposite ends of transverse cutting edge 42*a* to provide an effective depth gauge setting noted by dimension 74.

Figure 6:
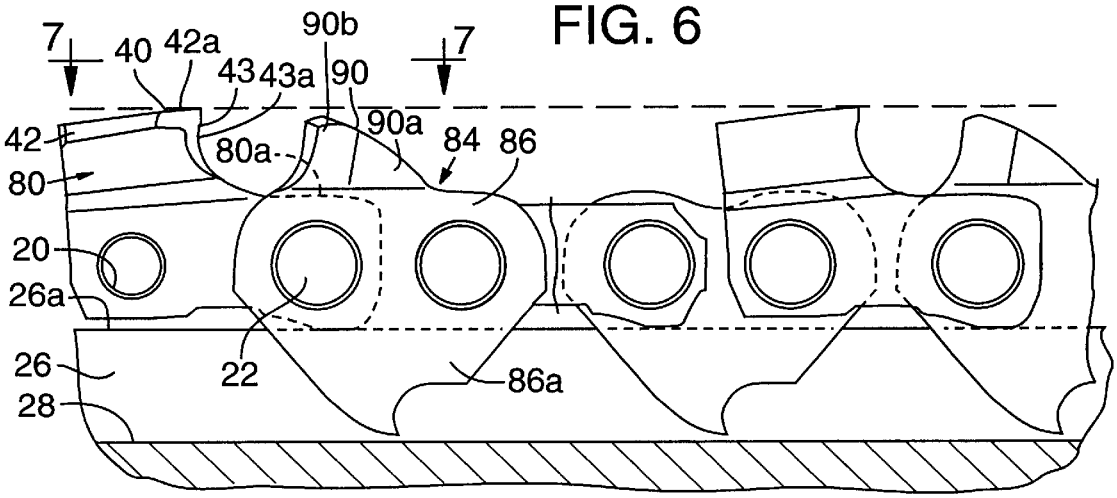
FIG. 6 is a side elevation view of a section of a saw chain in which certain links bear cutter elements and leading center drive link elements pivotally connected thereto have depth gauge portions according to an embodiment of the present invention.
Figure 7:
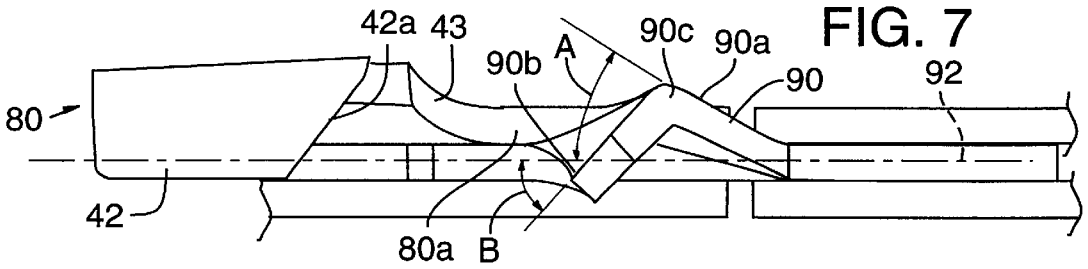
FIG. 7 is an enlarged top plan view taken generally along the line 7—7 in FIG. 6.

Reference is now made to the embodiment illustrated in FIGS. 6 and 7. In this embodiment of the invention, each cutter link 80 in the cutter chain, or cutter device, has a cutter portion 40 with a bent-over top plate 42 and an upstanding side plate 43 having sharpened leading edges 42*a*, 43*a*, respectively. Bores 20 at the front and rear sections of the cutter provide receiving apertures for rivets 22 to connect the cutter link to adjacent links in the chain.

The forward portion of cutter link 80 does not have a depth gauge thereon. The top of the forward portion of cutter link 80, noted at 80*a* in dashed line is substantially the top of the main body portion.

Connected to the forward portion of cutter link 80 is a center drive link 84. The center drive link has a substantially planar main body portion 86 with a depending tang 86*a* which rides in bar groove 26 and may be engaged by a drive sprocket of a chain saw power head. It also has bores adjacent its forward and rearward ends to receive connecting rivets 22.

In this embodiment, depth gauge portion 90 is mounted on the center drive link 84 and extends upwardly from main body portion 86. The depth gauge portion includes a first, or front, section 90*a*, and a second, or rear, section 90*b*. These are joined by a juncture section 90*c*, best seen in the top view of FIG. 7.

As in the embodiment discussed in regard to FIGS. 1–5, the top surface of the front section 90*a* extends substantially continuously upwardly from the main body portion in a convex curve as it progresses rearwardly in the link to join with the second section 90*b*. The first section diverges from central plane 92 of the link at an angle A in a range of 2° to 90°, and more preferably in a range of 10° to 80°. From juncture section 90*c* which is formed in a convex outer curve, the second, or rear, section 90*b* extends rearwardly at an angle denoted generally at B to converge toward plane 92. Angle B may be in a range of 2° to 90°, and more preferably in a range of 10° to 80°.

In this embodiment, the outer side surface of juncture section 90*c* must be displaced somewhat further from plane 92 than in the embodiment illustrated in FIGS. 1–5 to provide adequate side plate depth cut control. However, this means merely that the plate element from which the center drive link is formed need merely be deformed more than that shown in the previously described embodiment.

The formation and operation of the depth gauge 90 on center drive link 84 is substantially similar to that on the embodiment illustrated in FIGS. 1–5. Explaining further, the depth gauge leads the cutter 40 and provides a depth gauge which ramps substantially continuously upwardly from the main body portion of link 84 to provide a depth gauge, as seen by the kerf cut in the workpiece which is substantially greater in width than the thickness of the material from which it is formed. It also provides an uppermost, or top, depth gauge surface which is intermediate the side-to-side dimensions of the hooded top plate on the cutter and provides good side plate cutting depth gauge control at juncture section 90*c*.

Figure 8:
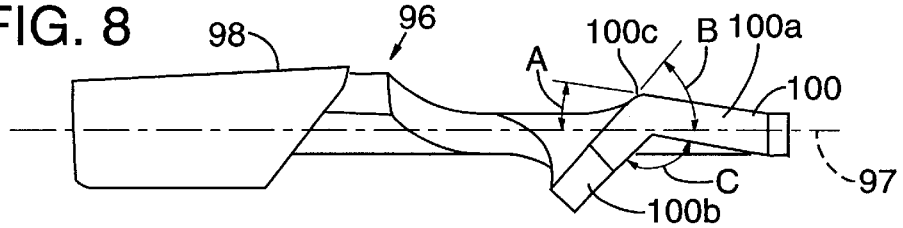
FIG. 8 is a top plan view of an alternate embodiment of a cutter link according to an embodiment of the invention.
Figure 8A:
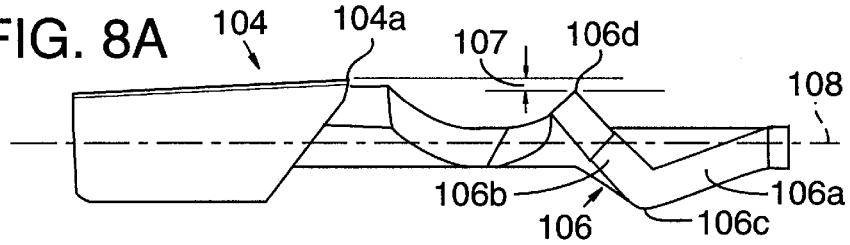
FIG. 8A is a top plan view of a cutter link somewhat similar to FIG. 8, but with the depth gauge portion deformed oppositely to that illustrated in FIG. 8.

FIGS. 8 and 8A are top plan views of cutters somewhat similar to that illustrated in FIG. 3. In FIG. 8 a cutter link 96 has a main body with a central plane denoted generally at 97. The link includes a cutter portion 98 mounted at the rear end thereof, and a depth gauge portion 100 mounted at the forward end thereof. As seen from above, the forward, or first, section, 100*a* is bent outwardly from the plane 97 of the body to diverge therefrom in the direction of the side plate cutter portion of the trailing cutter 98. As will be recalled, the depth gauge portions 52*a*, 52*b* of the cutter illustrated in FIG. 3 had a slight curvature thereto. The first section 100*a* and second section 100*b* of the depth gauge shown in FIG. 8, on the other hand, have substantially straight sides as viewed at their top surfaces. Again, juncture section 100*c* between sections 100*a*, 100*b* provides a convexly curved outer side surface which is the point at which the depth gauge extends furthest to one side of plane 97.

Referring to FIG. 8A, a cutter 104, somewhat similar to that previously described at 96 is illustrated. However, in this embodiment the depth gauge 106 has a first section 106*a* which diverges on progressing rearwardly from central plane 108 away from the side plate cutting edge 104*a* of the cutter, as opposed to toward the side plate cutting edge, as in the previously described embodiments. First section 106*a* proceeds rearwardly to a juncture section 106*c* from which rear section 106*b* then converges toward plane 108, to cross plane 108 to its end terminus point 106*d*. The end point 106*d* stops short of the lateral position of side cutting edge 104*a* by a distance denoted 107, to provide a side plate depth setting.

In FIGS. 9–12, a cutter 112 constructed according to another embodiment of the invention is illustrated. The main body portion 114 again has a substantially central plane denoted at 116. A rear-mounted cutter portion 118 has a laterally extending top plate cutting edge 118*a* and an upright side plate cutting edge 118*b*. A forwardly-mounted depth gauge portion 120 extends generally upwardly from main body 114 and is deformed laterally to one side of plane 116. Although the depth gauge could be deformed to either side of the plane (as is indicated by the reverse designs shown in FIGS. 8 and 8*a*) in this instance it is shown deformed to the side of the cutter away from side cutting edge 118*b*.

The first, or forward, section 120*a* extends generally upwardly from main body section 114. The first section has a forwardmost portion which lies in the plane of body 114. On progressing rearwardly from this forwardmost portion an upper portion of the first section diverges from plane 116 at an angle indicated generally at A.

Figure 10:
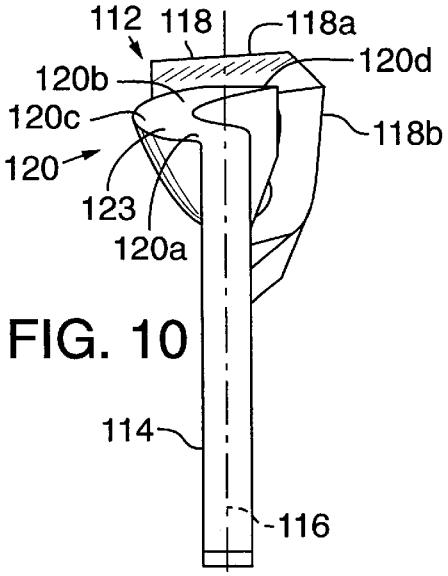
FIG. 10 is a front elevation view of the cutter of FIG. 9.
Figure 11:
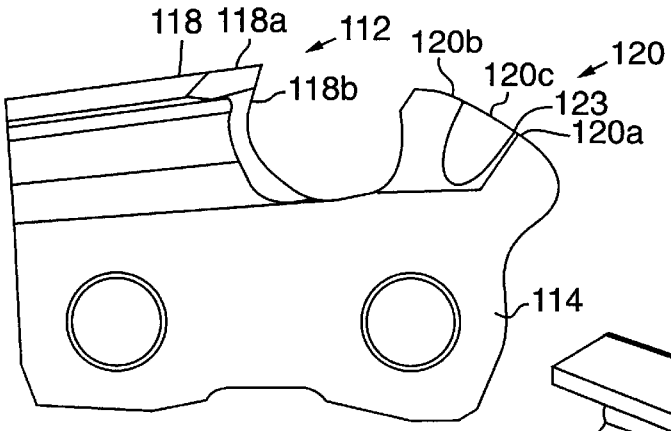
FIG. 11 is a side elevation view of the cutter link of FIG. 9.
Figure 12:
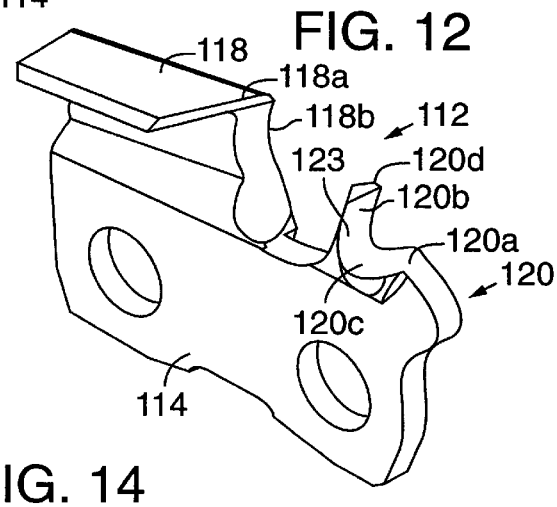
FIG. 12 is a perspective view of the cutter link of FIG. 9.

Second, or rear, section 120*b* converges toward plane 116 at an angle indicated generally at B. Sections 120*a* and 120*b* are interconnected by a juncture section 120*c*. Second section 120*b* extends across plane 116 to a terminal end portion 120*d*. This terminal end 120*d* is spaced a distance 122 from side plate cutting edge 118*b* to provide a side plate depth gauge setting. Again, the upper surface, or edge, 123 of the depth gauge as shown in FIG. 10 presents a depth gauge sweep in the kerf which is substantially wider than the thickness of the material from which it is formed and is a short distance below top plate cutting edge 118*a* to provide a top plate depth gauge control setting. Further, as shown in FIG. 11 surface 123 is formed in a substantially arcuate configuration extending upwardly on progressing rearwardly in the depth gauge.

Figure 9:
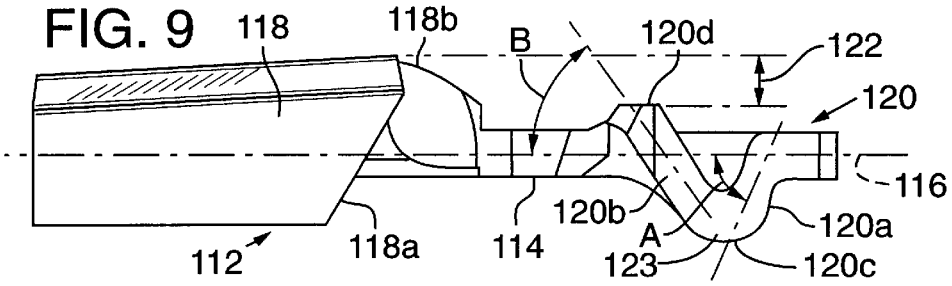
FIG. 9 is a top plan view of a cutter link having a depth gauge according to another embodiment of the invention.

In the embodiment illustrated in FIGS. 9–12, and as more clearly shown in FIG. 9, the angle at which the diverging portion of the front section 120*a* is disposed relative to plane 116 is greater than that illustrated for prior embodiments. As shown here, angle A is approximately 70° but could approach 90°. Further, since section 120*a* is disposed at a greater angle relative to plane 116 this shifts junction section 120*c* further forward in the cutter, and thus farther away from cutting edge 118*a* which can improve the cutting performance of the device.

Figure 10A:
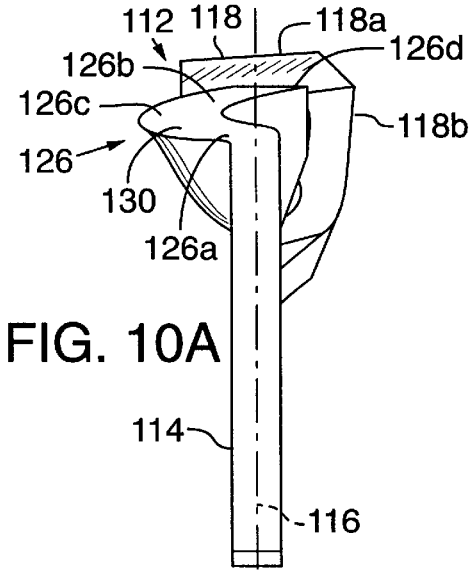
FIG. 10A is a front elevation view similar to FIG. 10, but with a wiped-style enlarged top surface.

Referring to FIG. 10A, a front view of a cutter somewhat similar to FIG. 10, is illustrated with similar portions of the cutter given like numbers. However, here the upper surface of the depth gauge is deformed to one side in what may be termed a mechanical wiping, rolling, or swaging, operation to produce a wider flared top surface with greater surface area to engage the workpiece.

Explaining further, the depth gauge portion indicated at 126 has forward, rearward and junction sections 126*a*, 126*b*, 126*c*, respectively.

The difference here is that during the manufacturing process, as the major portion of the depth gauge is being deformed laterally of plane 116, a further deformation of the upper surface may be produced by a wiping action of a hardened tool pressed against and moved laterally across the upper surface 130 in a direction perpendicular to plane 116 and to the left in FIG. 10A. This wiping action further deforms the upper surface 130 of the depth gauge in the region of juncture 126*c*, to produce a flared portion which is wider than body material 114. This forming process results in greater top surface area for the depth gauge to provide additional advantages as set out above that result from increased top surface area.

As indicated above, a flared upper surface for the depth gauge could be produced by other production methods also, such as by rolling or swaging.

Figure 13:
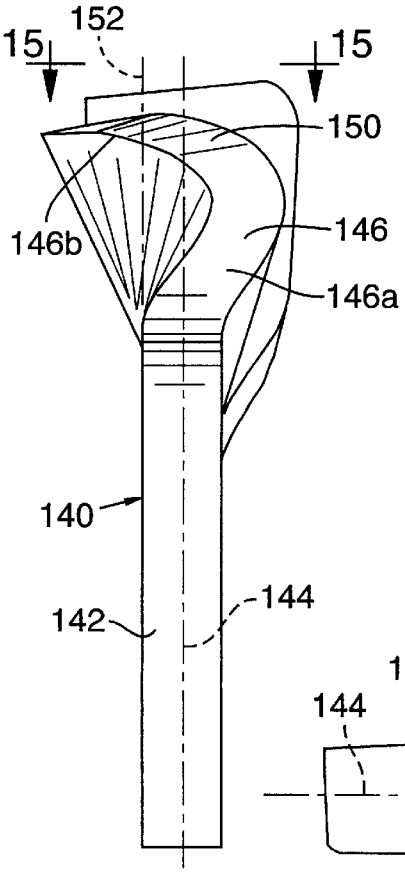
FIG. 13 is a front elevation view of another embodiment of the invention.
Figure 14:
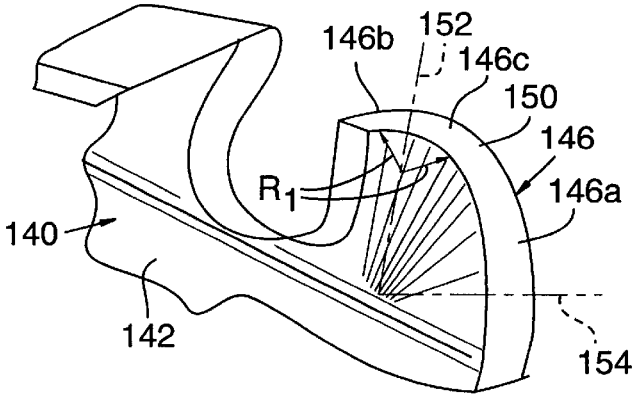
FIG. 14 is an enlarged perspective view of a forward portion of the cutter link illustrated in FIG. 13.
Figure 15:
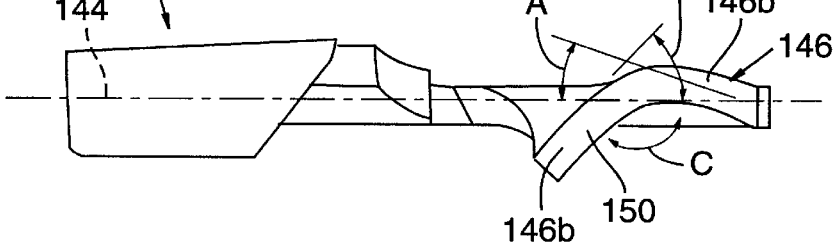
FIG. 15 is a top plan view of the cutter link shown in FIG. 13.

FIGS. 13, 14, and 15 illustrate another embodiment of the invention. Here again, a cutter 140 has a substantially planar body section 142 with a central plane 144. The depth gauge portion 146 has forward and rearward sections 146*a*, 146*b* respectively, with an upper surface 150. The depth gauge is substantially conoid in configuration. The major portions of first and second sections 146*a*, 146*b* are deformed in a substantially conical configuration about a substantially upright central axis 152 which extends upwardly from main body 142. The upper surfaces in the region of juncture section 146*c* are formed at a radius noted $R_1$.

The forward portion of section 146*a* may be deformed in a somewhat conical form about another axis 154 which is at a low angle relative to the horizontal.

Although the invention has been described thus far in the form of cutter links and center drive links for saw chain, it should be understood that a depth gauge thus formed could be provided on tie straps as well as cutter and drive links in a cutting chain. Further, although the embodiments shown and described herein illustrate, as in FIG. 9, a first bend of the forward section outwardly and away from the plane of the body, and a second bend at the juncture section, so that the second section converges toward the plane of the body, it should be recognized that additional bends may be provided to produce a more rippled, or wavy, design without departing from the spirit of the invention.

Figure 16:
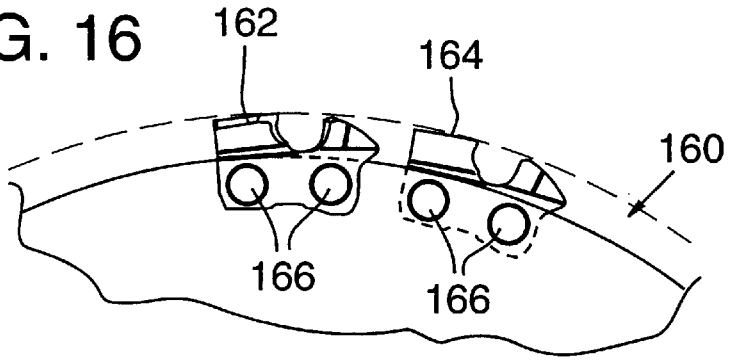
FIG. 16 is a partial side elevation view of a circular saw disk having cutter elements according to the present invention secured to its peripheral edge.
Figure 17:
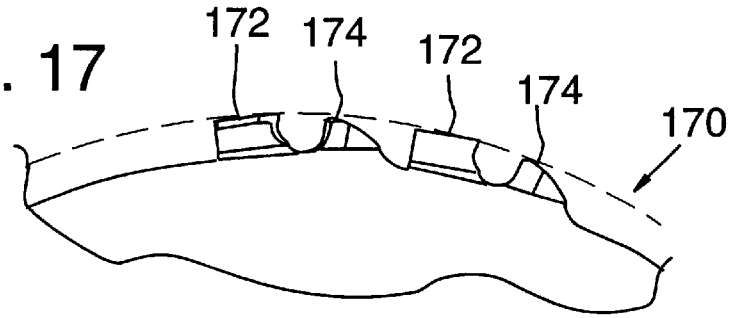
FIG. 17 is a partial side elevation view of a circular saw having cutters formed according to an embodiment of the invention in the peripheral edge of the cutter disk.
Figure 18:
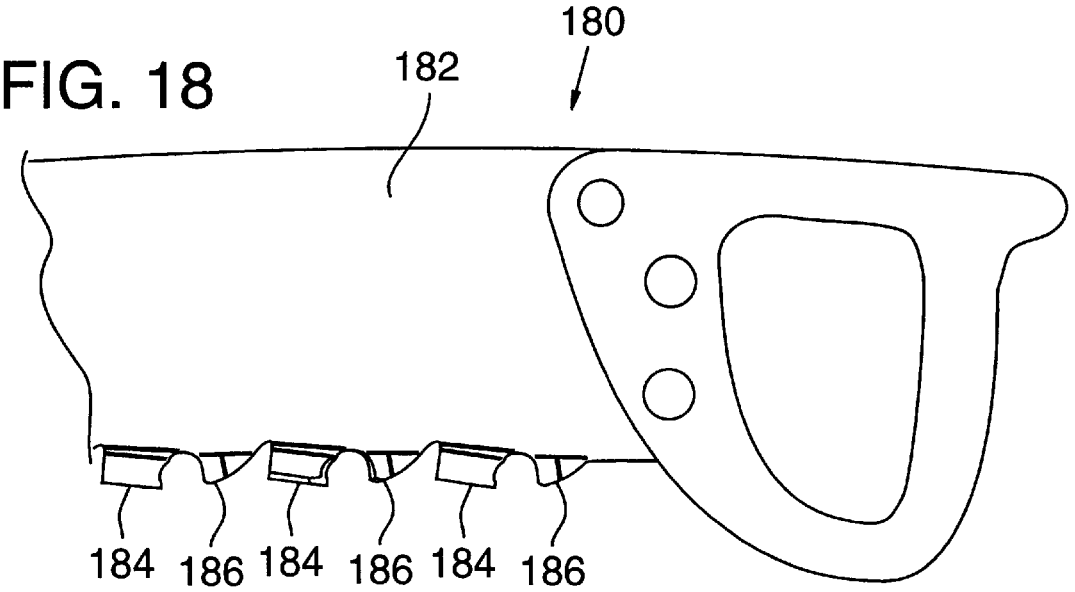
FIG. 18 is a side elevation view of a portion of a hand saw, the blade of which bears cutters with depth gauge portions formed according to an embodiment of the invention.

Various additional uses of cutters and depth gauges according to embodiments of the invention are illustrated in FIGS. 16–18. Here, the cutters and depth gauges are not mounted on a cutter chain for a chain saw. Instead, in FIG. 16, a circular saw disk 160 has left and right hand cutters 162, 164 secured thereto by rivets 166. These cutters may have any of the configurations illustrated and described herein or as covered by a following claim.

FIG. 17 illustrates that a saw disk 170 may have formed on the periphery thereof (rather than merely being attached thereto) a plurality of cutters 172 which are led by depth gauge portions 174. Again, these may be formed as described in any of the previously discussed embodiments or any that are covered by the appended claims.

Finally, FIG. 18 illustrates a hand saw 180, having a blade 182 with cutters 184 which are led by depth gauges 186 according to the present invention.

While particular embodiments of the present invention have been illustrated and described herein, it should be obvious to those skilled in the art that variations, modifications, and added uses are possible without departing from the spirit of the invention as set out in the appended claims.

I claim:

1. A cutter for cutting a kerf in a work piece, the cutter being formed from a plate element having a defined thickness and in an upright position comprising a body portion having said defined thickness and disposed in a substantially upright plane, said body portion having forward and rearward regions, a cutting portion on the rearward region having a forwardly facing cutting edge which extends upwardly to a selected elevation above the body portion and laterally of the plane of the body portion to a first distance to one side of said plane, and a depth gauge portion on the forward region projecting upwardly from said body portion, said depth gauge portion including an upwardly facing upper surface wherein said upper surface has a generally constant width substantially equal to said defined thickness, said depth gauge portion having a first section and a second section joined to and progressing rearwadly from said first section, wherein in said first section, said upper surface is disposed at a first angle diverging from said plane on progressing reawardly in the cutter, and in said second section, said upper surface converges toward and intersects said plane, said second section upper surface extending beyond said plane at an angle relative thereto and diverging from said plane on progressing rearwardly at the side of said plane opposite said one side, said first and second section upper surfaces being formed such that on progressing rearwardly they progress substantially upwardly through said first section and into said second section.

2. The cutter of claim 1, wherein said first and second sections are joined by a juncture section disposed to one side of said plane and a portion of said juncture section defines the greatest distance to which said depth gauge extends to said one side of the plane.

3. A cutter for movement along a path for cutting a kerf in a work piece, said cutter in an upright position comprising a body portion having a substantially upright central plane and having forward and rearward regions, a cutting portion on the rearward region having a forwardly facing cutting edge at a selected elevation above the body portion, and a depth gauge portion on the forward region projecting upwardly from said body portion, said depth gauge portion including an upwardly facing work-engaging upper surface wherein said upper surface has a generally constant width substantially equal to a thickness of said body portion, said depth gauge portion having a first section and a second section rearwardly of said first section, wherein in said first section, said upper surface is disposed at a first angle greater than 2 degrees relative to said plane, and in said second section, said upper surface is disposed at a second angle greater than 2 degrees relative to said plane, and on progressing rearwardly in said cutter said first section upper surface diverges from said plane, joins with said second section upper surface, and said second section upper surface extends toward and crosses said plane, said first and second section upper surfaces being formed such that on progressing rearwardly they progress substantially upwardly through said first section and into said second section.

4. The cutter of claim 3, wherein said first and second sections are joined by an intermediate juncture section disposed to one side of said plane and a portion of said juncture section defines the greatest distance to which said depth gauge extends to said one side of the plane.

5. The cutter of claim 4, wherein an outer surface of said juncture section facing away from said plane is formed in a convex curve.

6. The cutter of claim 3, wherein said first angle at which the first section upper surface diverges from said plane is in a range of from 2° to 90°.

7. The cutter of claim 3, wherein said first angle at which the first section upper surface diverges from said plane is in a range of from 10° to 80°.

8. The cutter of claim 3, wherein the second angle at which the second section upper surface converges toward said plane is in a range of from 2° to 90°.

9. The cutter of claim 3, wherein the second angle at which the second section upper surface converges toward said plane is in a range of from 10° to 80°.

10. The cutter of claim 3, wherein on progressing rearwardly in said cutter said first section diverges from one side of said plane and a portion of said second section diverges from the opposite side of said plane.

11. The cutter of claim 3, wherein said first and second sections are bent relative to each other about a line that extends upwardly from said body.

12. The cutter of claim 3, wherein said first and second sections define an included angle therebetween in a range of about 4° to 160°.

13. The cutter of claim 12, in which said first and second sections have face surfaces at the inner side of said included angle and at least one of said face surfaces has a plurality of carrying elements formed thereon to assist in moving chips cut from a workpiece along the kerf.

14. The cutter of claim 13, wherein said carrying elements comprise depressed lines formed into said face extending generally upwardly in said face.

15. The cutter of claim 13, wherein said carrying elements comprise spaced projections extending outwardly from said face.

16. The cutter of claim 3, wherein said depth gauge portion is formed from a plate element having opposed substantially parallel face surfaces extending generally upwardly from said body portion and said upper surface extends between said face surfaces, wherein said upper surface is formed in an arc which progresses substantially upwardly through said first section and into said second section.

17. The cutter of claim 16 wherein the upper surface extends transversely of said central plane to produce an effective depth gauge width as viewed from the front of the depth gauge which is at least twice the distance between said face surfaces.

18. A cutter for movement along a path for cutting a kerf in a work piece, said cutter in an upright position comprising a body portion having a substantially upright central plane and having forward and rearward regions, a cutting portion on the rearward region having a forwardly facing top cutting edge at a selected elevation above the body portion, and a depth gauge portion on the forward region projecting upwardly from said body portion, said depth gauge portion including an upwardly facing work-engaging upper surface wherein said upper surface has a generally constant width substantially equal to a thickness of said body portion, said depth gauge portion having a first section and a second section rearwardly of said first section, wherein in said first section, said upper surface is disposed at a first angle greater than 2 degrees relative to said plane, and in said second section, said upper surface is disposed at a second angle greater than 2 degrees relative to said plane, wherein on progressing rearwardly, said first section upper surface diverges from said plane and said second section upper surface converges toward said plane, said cutter portion has a side cutting edge spaced a selected first distance laterally to one side of said plane, said top cutting edge extends transversely of said plane to a selected second distance beyond the side of said plane opposite said one side, and an outermost side portion of said depth gauge is spaced laterally to said one side of said plane intermediate said plane and said first distance, and said depth gauge extends to said opposite side of the plane a distance greater than said second distance.

19. A cutter for movement along a path for cutting a kerf in a work piece, said cutter in an upright position comprising a body portion having a substantially upright central plane and having forward and rearward regions, a cutting portion on the rearward region having a forwardly facing cutting edge at a selected elevation above the body portion, and a depth gauge portion on the forward region projecting upwardly from said body portion, said depth gauge portion including an upwardly facing work-engaging upper surface wherein said upper surface has a generally constant width substantially equal to a thickness of said body portion, said depth gauge portion having a first section and a second section rearwardly of said first section, wherein in said first section, said upper surface is disposed at a first angle greater than 2 degrees relative to said plane, and in said second section, said upper surface is disposed at a second angle greater than 2 degrees relative to said plane, said first section has a forwardmost portion occupying said plane, said first section upper surface diverges from said plane on proceeding rearwardly to a first position disposed laterally to one side of said plane, said second section upper surface extends rearwardly from said first section and on proceeding rearwardly converges toward said plane from said one side and crosses said plane to a second position at the opposite side of said plane, and said cutting edge extends transversely of said plane a distance to said one side of said plane beyond said second position and extends to said opposite side of said plane a distance short of said first position.

20. A cutter device for movement along a path for cutting a kerf in a work piece, said cutter device in an upright position comprising a cutter portion, a body portion having a substantially upright central plane, a cutter portion projecting upwardly from said body portion, and a depth gauge portion projecting upwardly from said body portion, said depth gauge portion including an upwardly facing work-engaging upper surface wherein said upper surface has a generally constant width substantially equal to a thickness of said body portion, said depth gauge portion having a first section and a second section rearwardly of said first section, wherein in said first section, said upper surface is disposed at a first angle greater than 2 degrees relative to said plane, and in said second section, said upper surface is disposed at a second angle greater than 2 degrees relative to said plane, said second section upper surface extending upwardly from said first section upper surface on progressing rearwardly, and on progressing rearwardly in said cutter device said first section upper surface diverges from said plane, joins with said second section upper surface, and the second section upper surface extends toward and crosses said plane.

21. A cutter device for movement along a path for cutting a kerf in a work piece, said cutter device in an upright position comprising a cutter portion, a body portion having a substantially upright central plane, a cutter portion projecting upwardly from said body portion, and a depth gauge portion projecting upwardly from said body portion, said depth gauge portion including an upwardly facing work-engaging upper surface wherein said upper surface has a generally constant width substantially equal to a thickness of said body portion, said depth gauge portion having a first section and a second section rearwardly of said first section, wherein in said first section, said upper surface is disposed at a first angle greater than 2 degrees relative to said plane, and in said second section, said upper surface is disposed at a second angle greater than 2 degrees relative to said plane, said second section upper surface extending upwardly from said first section upper surface on progressing rearwardly, said first section has a forwardmost portion occupying said plane, said first section diverges from said plane on proceeding rearwardly to a first position disposed to one side of said plane, and said second section extends rearwardly from said first section and on proceeding rearwardly converges toward said plane from said one side and crosses said plane to a second position at the opposite side of said plane.

22. The cutter device of claim 21, wherein said first and second sections define an included angle therebetween in a range of about 4° to 160°.

23. The cutter device of claim 21, wherein the second section upper surface progresses upwardly from said first section upper surface on progressing rearwardly.

24. The cutter device of claim 23, wherein said first and second section upper surfaces define an upwardly directed arc.

* * * * *

UNITED STATES PATENT AND TRADEMARK OFFICE
CERTIFICATE OF CORRECTION

PATENT NO. : 6,058,825

DATED : May 9, 2000

INVENTOR(S) : Michael D. Harfst

It is certified that error appears in the above-identified patent and that said Letters Patent is hereby corrected as shown below:

In the Claims:

Column 11, line 25, claim 1, "reawardly" should be --rearwardly--.

Column 13, line 42, claim 20, and column 14, line 16, claim 21, in the third line of each claim, delete "a cutter portion,".

Signed and Sealed this

Eighth Day of May, 2001

*Attest:*

Nicholas P. Godici

NICHOLAS P. GODICI

*Attesting Officer*

*Acting Director of the United States Patent and Trademark Office*